United States Patent [19]

Schreiner et al.

[11] 3,993,481

[45] Nov. 23, 1976

[54] CONTACT MATERIAL FOR HIGH-POWER VACUUM CIRCUIT BREAKERS

[75] Inventors: Horst Schreiner, Nurnberg; Heinrich Hassler, Wendelstein, both of Germany

[73] Assignee: Siemens Aktiengesellschaft, Munich, Germany

[22] Filed: Sept. 17, 1975

[21] Appl. No.: 614,224

Related U.S. Application Data

[62] Division of Ser. No. 251,889, May 10, 1972, Pat. No. 3,948,652.

[52] U.S. Cl. ..... 75/170

[51] Int. Cl.[2] ..... C22C 19/03

[58] Field of Search ..... 75/170; 252/513

[56] References Cited

UNITED STATES PATENTS 3,437,479 4/1969 Nakajima ..... 75/170

3,655,368 4/1972 Walter ..... 75/170

*Primary Examiner*—Arthur J. Steiner

*Attorney, Agent, or Firm*—Kenyon & Kenyon, Reilly, Carr & Chapin

[57] ABSTRACT

A new material for making the electrical contacts of high-power vacuum circuit breakers comprises an alloy having as a base metal, a metal such as copper, nickel, iron, cobalt or titanium, and as an alloying metal, a metal such as bismuth, tellurium or lead, this alloy also including an auxiliary metal which forms a eutectic with the base metal used. The alloy has a fine grain size while at the same time a low gas content.

2 Claims, 2 Drawing Figures

CONTACT MATERIAL FOR HIGH-POWER VACUUM CIRCUIT BREAKERS

This is a division of application Ser. No. 251,889 filed May 10, 1972, now U.S. Pat. No. 3,948,652.

BACKGROUND OF THE INVENTION

This invention relates to materials used for the electrical contacts of high-power vacuum circuit breakers and which must be as free as possible from welding tendencies causing the contacts to weld together when subjected to arcing caused by opening and closing of the contacts.

Such contact materials may be an alloy of a base metal having a melting point above 1000° C. and below 1800° C., such as copper, nickel, iron, cobalt or titanium, and an alloying metal such as bismuth, tellurium or lead. These alloying metals do not form solid solutions with these base metals, either at all or at most to a very small degree. Therefore, during solidification of the alloy from its molten phase, these alloying metals form precipitations at the grain boundaries of the base metals. These precipitations inhibit the welding tendency when the alloy is used in the form of electrical contacts.

If such an alloy has too large a grain size, the weld inhibiting precipitations may be so widely dispersed as to appreciably reduce their desired effect. Such an alloy, when solidified very rapidly from its liquid phase, such as by casting it in a chilled mold, may be produced with a fine grain size. However, because the alloy inevitably contains some gases dissolved in it while molten, such rapid solidification does not permit adequate removal of these gases, the gases remaining in the solid alloy either as dissolved or bound gases, the resulting gas content exceeding that considered to be permissible when the alloy is used in the form of electrical contacts.

The object of the present invention is to produce an alloy of the kind described having both a fine grain size and a low gas content.

SUMMARY OF THE INVENTION

According to the invention, the described kind of alloy is improved by the addition of at least one auxiliary metal which forms a eutectic with the base metal or the base metal and its alloying metal or metals. The amount of this auxiliary metal is such that the eutectic formed occupies at least 15% and not more than 50% of the total volume of the alloy, a range of from 15% to 25% of the total volume being preferred. The result may be either a hypoeutectic or a hypereutectic alloy. When the alloy is permitted to cool slowly, fine grain crystals of the base metal and auxiliary metal in solid solution form while the eutectic remains liquid, gases expelled from these crystals being transferred to this liquid phase and permitting their removal by evacuation of the solidifying alloy. The ultimate result is a fine grain structure with the grains containing the eutectic in a finely dispersed condition and with the alloying metal precipitate surrounding the grains to perform its intended function; the amount of alloying metal which may dissolve in the other metals or alloys should not exceed 5%. The gas content of the alloy is adequately low for the use described.

DESCRIPTION OF THE PREFERRED EMBODIMENTS

As a preface to the following, the base metal involved determines the preferred auxiliary metal to be used. If the base metal is copper, the auxiliary metal may be selected from the group consisting of silver, cerium, germanium, lanthanum, magnesium, titanium or zirconium. When nickel is the base metal, boron, beryllium, carbon, cerium, lanthanum, magnesium, tin or titanium may be used. In the case of iron being the base metal, beryllium, boron, carbon, germanium, niobium, titanium or zirconium may be used. When cobalt is the base metal, the auxiliary metal may be boron, carbon, germanium, niobium, antimony, silicon, tin or titanium. Finally, when titanium is the base metal, nickel may be used. Tellurium, bismuth or lead may be used in the case of any of these base metals as the alloying metal providing the weld inhibiting effect.

In the alloys of the type described it has surprisingly been possible to achieve the object of this invention; namely, a fine grain structure and at the same time a low gas content.

Figure 1:
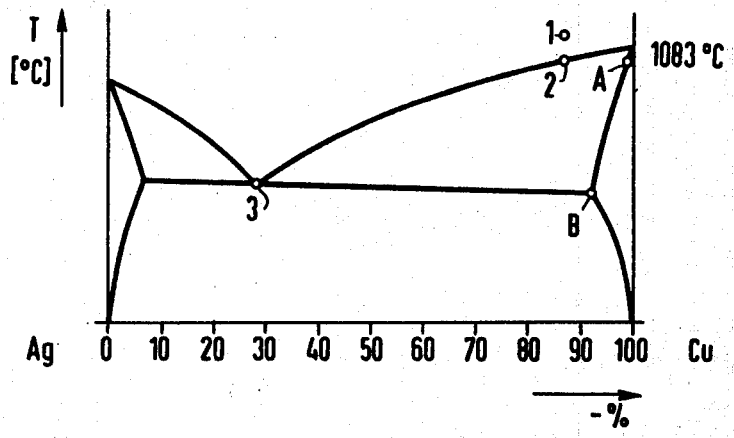
FIG. 1 is a typical fusibility curve of an alloy embodying the invention.
Figure 2:
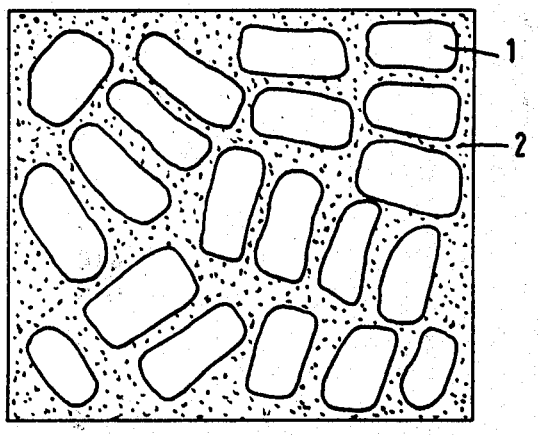
FIG. 2 is a draftsman's simulation of the microstructure obtained, the scale of this figure being greatly enlarged.

How these effects come about will now be described in the case of a base alloy with an addition of Te as the alloying element, and Ag as the auxiliary metal. The alloy consists of 85% by weight of Cu, 14% by weight of Ag and 1% by weight of Te, and is melted by electric induction heating under vacuum at 1100° C. To prevent the Te from evaporating in the vacuum, the melting is carried out in a covered graphite crucible having a porosity of about 20%. In the phase diagram of FIG. 1, the molten state at 1100° C. corresponds to the point 1. As the melt is cooled slowly, the point 2 is reached, CuAg solid-solution crystals being precipitated as composition A. As the solubility of Te in the solid solution is very low, it remains in solution in the liquid phase. As the CuAg solid-solution crystals crystallize out in very fine form, their gas solubility drops at the same time sharply and gases from these crystals are transferred to the liquid phase, whereby the gas concentration in the liquid phase increases beyond the equilibrium value existing at the time. The state of equilibrium is then re-established through loss of gases from the melt to the surrounding vacuum, and through this process a degassing of the alloy is achieved. The degassing mechanism is here a diffusion process, in which the degassing is brought about by the difference of the concentration of the gases in the liquid phase and the adjacent vacuum. With further slow cooling, the composition of the liquid phase changes along the curve 2 – 3 toward the point 3, while the solid-solution crystals simultaneously grow along the curve A – B, according to the relations which can be seen from the phase diagram. As the temperature drops further, the eutectic concentration of the solidifying alloy is finally reached at the point 3. The eutectic then solidifies very rapidly, so that the Te contained therein is precipitated as a fine dispersion. The completely solidified alloy thus shows a structure which is illustrated in FIG. 2 and described below.

Elongated CuAg mixed crystals 1 with extremely low gas content are embedded in a CuAg background mass 2 of eutectic composition, in which the added quantity of Te has precipitated in a finely dispersed condition. The gas content of the eutectic 2 corresponds to the equilibrium value according to the conditions prevailing in the vacuum process. As the gas content of the solid-solution crystals 1, however, corresponds to the equilibrium value of the solid body, as already mentioned, an overall reduction in the gas content has taken place, as compared to quenched alloys in which no equilibrium condition is reached. The formation of the solid-solution crystals 1 is of a magnitude of 100 to 200 microns, so the desired fine-grained structure has at the same time occurred, in contrast to alloys without formation of a eutectic.

Investigations on CuBi and CuAgBi alloys showed in the first-mentioned case, with grain sizes of up to 6000 microns, a gas content of 26 to 30 mol ppm, while in the second case which used the present invention a gas content of 7 to 11 mol ppm was found, with grain sizes of only up to 400 microns. In order to achieve a gas content as low as possible, the quantity of the eutectic phase should be proportioned through a properly proportioned addition of the auxiliary metal forming the eutectic, in such a manner that all precipitating solid-solution crystals remain coated with the eutectic matter without isolated islands of eutectic developing. The reason for this requirement is that the gases present in the eutectic must have the opportunity to travel to the wall of the crucible in order to be passed to the vacuum. Gases in isolated islands of eutectic matter would be retained therein because their diffusion to the wall of the crucible would have to take place via a solid crystal phase, in which the diffusion velocity is extremely low.

The preparation of such alloys is based on the concept that the primarily precipitated crystals, solid-solution crystals or intermetallic compounds, should not touch each other during the solidification of the eutectic, but are to be separated by envelopes of the eutectic. The formation of isolated islands of eutectic substance must be avoided. From this follows a requirement for the quantitative ratio of the eutectic phase and the base metal and the solid-solution crystals, respectively. It has been found by experiment that, as previously indicated, the percentage of eutectic should not be less than 15% and, for reasons of a favorable burn-off behavior, not more than 50% of the total volume of material. As particularly advantageous, contents between 15% and 25% are preferred.

The preparation of a number of such alloys is described in the following examples.

EXAMPLE 1

In a covered, porous graphite crucible, which had been degassed beforehand by heating at about 2000° C., an alloy formulation of a Cu base with 4% Ge and 0.5% Te is melted by electric induction heating at 1100° to 1200° C. and homogenized. By slowly raising the induction coil from the crucible with a speed in the range of 5 to 50 mm per hour the heating zone is shifted, and the solidification begins to set in from the bottom and proceeds in the direction towards the top. At about 1060° C., Cu-Ge solid crystals begin to precipitate, while the remaining liquid phase becomes Ge-enriched and solidifies at 743° C. with a eutectic composition (about 24% by weight of Ge), the tellurium being precipitated as a fine dispersion in the eutectic.

EXAMPLE 2

Alloy formulation: Cu base, 2% Zr and 0.5% Bi
Melting and homogenizing at 1100° to 1200° C.
Start of solidification: at about 1060° C.
Primary precipitate: Cu crystallites
Solidification of the eutectic (Cu-9%Zr): at 965° C.
All other details as in Example 1.

EXAMPLE 3

In a boron nitride crucible which is equipped with a porous cover and heated in a vacuum at temperatures of about 2000° C., the alloy formulation of Fe as the base with 1% B and 0.3% Bi is melted in a vacuum at 1600° C. by induction heating and is homogenized. By slowly raising the heating coil at a speed in the range of 5 to 50 mm per hour, a directional solidification, starting from the bottom, is initiated. At a temperature of about 1430° C., Fe crystallites begin to precipitate, whereby the liquid phase increases in B until the eutectic composition of Fe with 3.8% B is reached, the eutectic mixture solidifying at 1149° C. and the Bi being precipitated finely dispersed in the eutectic.

EXAMPLE 4

Alloy formulation: Base metal Fe with 1% carbon and 0.3% Bi
Melting and homogenizing at 1600° C.
Start of solidification at about 1460° C.
Primary precipitate: FeC crystalline mixture
Solidification of the eutectic (4.3% C in Fe) at 1146° C.
All other details as in Example 3

EXAMPLE 5

Alloy formulation: Fe base, 4.5% Nb and 0.5% Bi
Melting and homogenizing at 1600° C.
Start of solidification: at about 1510° C.
Primary precipitate: FeNb crystalline mixture
Solidification of the eutectic (Fe with 18% Nb) at 1360° C.
All other details as in Example 3.

EXAMPLE 6

Alloy formulation: Ni base, 3.5% Ce and 0.5% Bi
Melting and homogenizing at 1500° C.
Start of solidification: at 1440° C.
Primary precipitate: Ni crystallites
Solidification of the eutectic (Ni with 19% Ce) at 1210° C.
All other details as in Example 3

EXAMPLE 7

Alloy formulation: Ni base, 10% Sn and 1% Te
Melting and homogenizing at 1500° C.
Start of solidification at 1400° C.
Primary precipitate: NiSn crystalline mixture
Solidification of the eutectic (Ni with 32.5% Sn) at 1130° C.
All other details as in Example 3

EXAMPLE 8

Alloy formulation: Ni base, 3% Ti and 0.5% Bi
Melting and homogenizing at 1500° C.
Start of solidification at 1440° C.
Primary precipitate: NiTi crystalline mixture
Solidification of the eutectic (Ni with 12% Ti) at 1304° C.

All other details as in Example 3

EXAMPLE 9

Alloy formulation: Co base, 10% Sn and 1% Te
Melting and homogenizing at 1550° C.
Start of solidification at 1410° C.
Primary precipitate: CoSn crystalline mixture
Solidification of the eutectic (Co with 34% Sn) at 1112° C.
All other details as in Example 3

EXAMPLE 10

Alloy formulation: Co base, 3% Si and 0.5% Pb
Melting and homogenizing at 1550° C.
Start of solidification at 1440° C.
Primary precipitate: CoSi crystalline mixture
Solidification of the eutectic (Co with 12.5% Si) at 1195° C.
All other details as in Example 3

EXAMPLE 11

Alloy formulation: Ti base, 5% Ni and 0.5% Bi
Melting and homogenizing at 1750° C.
Start of solidification at 1620° C.
Primary precipitate: TiNi crystalline mixture
Solidification of the eutectic (Ti with 28.5% Ni) at 942° C.
All other details as in Example 3

In the foregoing examples all percentages are by weight. The alloy compositions may include small amounts of other elements which do not affect the characteristics of the alloys and which are unavoidable under commercial operating conditions or may be added for special purposes.

What is claimed is:

1. A contact material for high-power vacuum circuit breakers comprising an alloy consisting essentially of a base metal cobalt, and at least one alloying metal tellurium, characterized by containing at least one auxiliary metal tin forming a eutectic with said base metal, said eutectic comprising about 15% to about 50% of the total volume of said alloy, said eutectic surrounding crystals consisting mainly of said base metal, said alloying metal being contained in said crystals and comprising not more than 5% by weight of said crystals and being dispersed in said eutectic to an extent of less than 5% by weight of said eutectic, and said alloy having an alloying formulation consisting essentially to 1% by weight of tellurium and 10% by weight of tin, with the balance being the cobalt base metal.

2. A contact material for high-power vacuum circuit breakers comprising an alloy consisting essentially of a base metal cobalt, and at least one alloying metal lead, characterized by containing at least one auxiliary metal silicon forming a eutectic with said base metal, said eutectic comprising about 15% to about 50% of the total volume of said alloy, said eutectic surrounding crystals consisting mainly of said base metal, said alloying metal being contained in said crystals and comprising not more than 5% by weight of said crystals and being dispersed in said eutectic to an extent of less than 5% by weight of said eutectic, and said alloy having an alloying formulation consisting essentially of 0.5% by weight of lead and 3.0% by weight of silicon, with the balance being the cobalt base metal.

* * * * *